US007517417B2

(12) United States Patent
Turner

(10) Patent No.: US 7,517,417 B2
(45) **Date of Patent: *Apr. 14, 2009**

(54) TANTALUM PVD COMPONENT PRODUCING METHODS

(75) Inventor: Stephen P. Turner, Moon, PA (US)

(73) Assignee: Honeywell International Inc., Morristown, NJ (US)

( * ) Notice: Subject to any disclaimer, the term of this patent is extended or adjusted under 35 U.S.C. 154(b) by 407 days.

This patent is subject to a terminal disclaimer.

(21) Appl. No.: 11/331,875

(22) Filed: Jan. 12, 2006

(65) Prior Publication Data

US 2006/0118212 A1 Jun. 8, 2006

Related U.S. Application Data

(60) Continuation-in-part of application No. 09/999,095, filed on Oct. 30, 2001, now Pat. No. 7,101,447, which is a division of application No. 09/497,079, filed on Feb. 2, 2000, now Pat. No. 6,331,233.

(51) Int. Cl.
*C22F 1/18* (2006.01)

(52) U.S. Cl. ..... 148/518; 148/668

(58) Field of Classification Search ..... 148/518, 148/668

See application file for complete search history.

(56) References Cited

U.S. PATENT DOCUMENTS

| | | | |
|---|---|---|---|
| 3,268,328 | A | 8/1966 | Torti, Jr. |
| 3,497,402 | A | 2/1970 | Douglas |
| 3,616,282 | A | 10/1971 | Bodway |
| 3,653,981 | A | 4/1972 | Watanabe et al. |
| 3,849,212 | A | 11/1974 | Thornburg |
| 4,000,055 | A | 12/1976 | Kumagai |
| 4,020,222 | A | 4/1977 | Kausche et al. |
| 4,374,717 | A | 2/1983 | Drauglis et al. |
| 4,466,940 | A | 8/1984 | Siewert et al. |

(Continued)

FOREIGN PATENT DOCUMENTS

| | | |
|---|---|---|
| AU | 252442 | 6/1960 |

(Continued)

OTHER PUBLICATIONS

Klein, C. et al., "Manual of Mineralogy", John Wiley & Sons, Inc. 1985, pp. 39-40.

(Continued)

*Primary Examiner*—George Wyszomierski

(57) ABSTRACT

A method for producing a tantalum PVD component includes a minimum of three stages, each of which include a deformation step followed by a high-temperature anneal. The deformation occurs in air and at a component temperature less than or equal to 750° F. in at least one of the minimum of three stages. The anneal occurs at a component temperature of at least 2200° F. in at least the first two of the minimum of three stages. The tantalum component exhibits a uniform texture that is predominately {111}<uvw>. As an alternative, the deformation may occur at a component temperature of from 200° F. to 750° F. in at least the last stage of the minimum of three stages. The anneal may occur at a component temperature of from 1500° F. to 2800° F. in at least three of the minimum of three stages.

28 Claims, 9 Drawing Sheets

U.S. PATENT DOCUMENTS

| | | | |
|---|---|---|---|
| 4,517,032 | A | 5/1985 | Goto et al. |
| 4,525,417 | A | 6/1985 | Dimigen et al. |
| 4,589,932 | A | 5/1986 | Park |
| 4,619,695 | A | 10/1986 | Oikawa et al. |
| 4,663,120 | A | 5/1987 | Parent et al. |
| 4,762,558 | A | 8/1988 | German et al. |
| 4,842,706 | A | 6/1989 | Fukasawa et al. |
| 4,844,746 | A | 7/1989 | Hormann et al. |
| 4,883,721 | A | 11/1989 | Nalepka et al. |
| 4,889,745 | A | 12/1989 | Sata |
| 4,960,163 | A | 10/1990 | Fang et al. |
| 5,074,907 | A | 12/1991 | Amato et al. |
| 5,087,297 | A | 2/1992 | Pouliquen |
| 5,171,379 | A | 12/1992 | Kumar et al. |
| 5,194,101 | A | 3/1993 | Worcester et al. |
| 5,231,306 | A | 7/1993 | Meikle |
| 5,282,946 | A | 2/1994 | Kinoshita et al. |
| 5,330,701 | A | 7/1994 | Shaw et al. |
| 5,400,633 | A | 3/1995 | Segal |
| 5,413,650 | A | 5/1995 | Jarrett et al. |
| 5,415,829 | A | 5/1995 | Ohhashi et al. |
| 5,418,071 | A | 5/1995 | Satou et al. |
| 5,456,815 | A | 10/1995 | Fukuyo et al. |
| 5,468,401 | A | 11/1995 | Lum |
| 5,508,000 | A | 4/1996 | Satou et al. |
| 5,513,512 | A | 5/1996 | Segal |
| 5,590,389 | A | 12/1996 | Dunlop |
| 5,600,989 | A | 2/1997 | Segal |
| 5,608,911 | A | 3/1997 | Shaw et al. |
| 5,623,726 | A | 4/1997 | Kiiski et al. |
| 5,673,581 | A | 10/1997 | Segal |
| 5,693,203 | A | 12/1997 | Ohhashi |
| 5,722,165 | A | 3/1998 | Kobayashi et al. |
| 5,766,380 | A | 6/1998 | Lo et al. |
| 5,772,795 | A | 6/1998 | Lally et al. |
| 5,772,860 | A | 6/1998 | Sawada et al. |
| 5,780,755 | A | 7/1998 | Dunlop |
| 5,798,005 | A | 8/1998 | Murata et al. |
| 5,809,393 | A | 9/1998 | Dunlop et al. |
| 5,826,456 | A | 10/1998 | Kawazoe et al. |
| 5,850,755 | A | 12/1998 | Segal |
| 5,993,575 | A | 11/1999 | Lo et al. |
| 5,993,621 | A | 11/1999 | Liu |
| 5,994,181 | A | 11/1999 | Hsieh et al. |
| 6,024,852 | A | 2/2000 | Tamura |
| 6,085,966 | A | 7/2000 | Shimomuki et al. |
| 6,113,761 | A | 9/2000 | Kardokus et al. |
| 6,123,896 | A | 9/2000 | Meeks, III et al. |
| 6,130,451 | A | 10/2000 | Hasegawa |
| 6,139,701 | A | 10/2000 | Pavate et al. |
| 6,192,969 | B1 | 2/2001 | Bunn et al. |
| 6,193,821 | B1 | 2/2001 | Zhang |
| 6,221,178 | B1 | 4/2001 | Torizuka et al. |
| 6,348,113 | B1 | 2/2002 | Michaluk |
| 6,348,139 | B1 | 2/2002 | Shah |
| 6,454,994 | B1 | 9/2002 | Wang |
| 6,521,173 | B2 | 2/2003 | Kumar |
| 7,101,447 | B2 * | 9/2006 | Turner ..... 148/518 |
| 2001/0023726 | A1 | 9/2001 | Koenigsmann et al. |
| 2002/0041819 | A1 | 4/2002 | Kumar et al. |

FOREIGN PATENT DOCUMENTS

| | | | |
|---|---|---|---|
| DE | 284905 | A5 | 11/1990 |
| EP | 0281141 | B2 | 3/1988 |
| EP | 0 590 904 | | 4/1994 |
| EP | 882 813 | | 12/1998 |
| EP | 0902102 | A1 | 3/1999 |
| JP | 55-179784 | | 12/1980 |
| JP | 59227992 | A | 12/1984 |
| JP | 62089543 | A | 4/1987 |
| JP | 62-297463 | | 12/1987 |
| JP | 62089543 | | 12/1987 |
| JP | 03-082773 | | 4/1991 |
| JP | H03-197640 | A | 8/1991 |
| JP | 6-10107 | | 6/1992 |
| JP | 6-93400 | | 9/1992 |
| JP | 6-256919 | | 3/1993 |
| JP | 6 264232 | | 9/1994 |
| JP | 08-134606 | | 5/1996 |
| JP | 08146201 | A | 6/1996 |
| JP | 8-232061 | | 9/1996 |
| JP | 8-269701 | | 10/1996 |
| JP | 10008244 | A | 1/1998 |
| WO | WO 87/07650 | | 12/1987 |
| WO | WO 92/01080 | | 1/1992 |
| WO | WO 9902743 | | 1/1999 |
| WO | WO 9927150 | | 6/1999 |
| WO | WO 99/66100 | | 12/1999 |
| WO | WO 00/31310 | | 6/2000 |
| WO | WO 0129279 | | 4/2001 |

OTHER PUBLICATIONS

Wright, S. et al., "Effect of Annealing Temperature on the Texture of Rolled Tantalum and Tantalum-10 Tw.% Tungsten", Proceedings of the 2nd International Conference on Tungsten and Refractory Metals, 1994, pp. 501-508.

Wenk, Hans-Rudolf, "Preferred Orientation in Deformed Metals and Rocks: An Introduction to Modern Texture Analysis", Academic Press 1985, pp. 8-10.

Cullity, B., "Elements of X-Ray Diffraction, Second Edition", Addison-Wesley Pub. Co., Inc., pp. 294-297.

Mukai, T. et al., "Dynamic Mechanical Properties of a Near-Nano Aluminum Alloy Processed by Equal-Channel-Angular-Extrusion", Nano-Structured Marterials, vol. 10, No. 5, pp. 755-765 (1998) Elsevier Sci. Ltd.

Hatch, J.E., *Aluminum*, 1984, Chap. 5, "Metallurgy of Heat Treatment and General Principles of Precipitation Hardening", pp. 134-157, 175-183.

Ferrasse, S. et al., "Development of a Submicrometer-Grained Microstructure in Aluminum 6061 Using Equal Channel Angular Extrusion", J. Mater Res., vol. 12, No. 5, May 1997, pp. 1253-1261.

Ferrasse et al., "Microstructure and Properties of Copper and Aluminum Alloy 3003 Heavily Worked by Equal Channel Angular Extrusion", Metallurgical an Materials Transactions, A: Physical Metallurgy & Materials Science, The Minerals, Metals and Materials Society, vol. 28A, No. 4, Apr. 1997, pp. 1047-1057.

V. Pavate et al., "Correlation between Aluminum alloy sputtering target metallurgical characteristics, Are initiation, and In-film defect density", SPIE vol. 3214, 1997, pp.g 42-47.

Cabot Performance Materials, "Material Evaluation Report", Mar. 25, 1998, Ingot No. T891C.

Domenic A. Canonico, "Stress-Relief Heat Treating of Steel", ASM Handbook, vol. 4, 1991.

ASM Handbook, vol. 4, 1991, "Heat Treating of Aluminum Alloys", pp. 841-879.

Hughes et al., "Grain Subdivision and the Development of Local Orientations in Rolled Tantalum", Tantalum, The Minerals, Metals & Materials Society, 1996, pp. 257-262 (Year is sufficiently early, so that the month is not an issue).

Arlt, Jr., "Sulfonation and Sulfonation to Thorium and Thorium Compounds", Kirk-Othmer Encyclopedia of Chemical Technology, vol. 22, pp. 541-564, 1993 (Year is sufficiently early so that the month is not an issue).

Kirkbride, et al., "The Effect of Yitrium on the Recrystallization and Grain Growth of Tantalum", J. Less-Common Metals, vol. 9, pp. 393-408, 1965 (Year is sufficiently early so that the month is not any issue).

National Research Corporation Press Release, pp. 1-4, Jul. 1964.

National Research Corporation Data Sheet "SGS Tantalum", pp. 1-7, no date.

ASTM Standard Specification for Tantalum and Tantalum Alloy Plate, Sheet, and Strip, pp. 558-561, 1992 (Year is sufficiently early so that the month is not an issue).

Kumar, et al., "Effect of Intermetallic Compounds of the Properties of Tantalum", Materials Research Society Symposium Proceedings, vol. 322, pp. 413-422, 1994 (Year is sufficiently early so that the month is not an issue).

Kumar, et al., "Effect of Intermetallic Compounds of the Properties of Tantalum", Refractory Metals & Hard Materials, vol. 12, pp. 35-40, 1994 (Year is sufficiently early so that the month is not an issue).

Klein, et al., "Inhomogeneous Textures in Tantalum Sheets", Materials Science Forum, vol. 157-162, pp. 1423, 1994 (Year is sufficiently early so that the month is not an issue).

Clark, et al., "Influence of transverse Rolling on the Microstructural and Texture Development in Pure Tantalum", Metallurgical Transactions, vol. 23A, pp. 2183-2191m, Aug. 1992.

Raabe, et al., "Texture and Microstructure of Rolled and Annealed Tantalum", Materials Science and Technology, vol. 10, pp. 299-305, Apr. 1994.

Wright, et al., "Texture Gradient Effects in Tantalum", International Conference on Textures of Materials, 7 pages, Sep. 1993.

Wright, et al., "Textural and Microstructural Gradient Effects on the Mechanical Behavior of a Tantalum Plate", Metallurgical Transactions A, 25A, 1994, pp. 1-17. (Year is sufficiently early so that the month is not an issue).

Clark, et al., "Effect of Processing Variables on Texture and Texture Gradients in Tantalum", Metallurgical Transactions A, vol. 22A, Sep. 1991, pp. 2039-2047.

Kumar, et al., "Corrosion Resistant Properties of Tantalum", Corrosion 95, Paper No. 253, 14 pages. (No date).

Segal, Materials Processing by Simple Shear, Materials Science and Engineering, A197, 1995, pp. 157-164.

Thomas Ruglic, Normalizing of Steel, ASM Handbook, vol. 4, Heat Treating, Copyright 1991, pp. 35-41.

"Nickel, Cobalt, and Their Alloys", ASM International, Dec. 2000, pp. 76, 230-234.

S. Sawada, "On Advanced Sputtering Targets of Refractory Metals and Their Silicides for VLSI-Applications", 12th International Plansee Seminar, 1989, Top 5: Ultrapure Refractory Metals, pp. 201-222.

P. Ding et al., "Copper Barrier, Seed Layer, and Planarization Technologies", Jun. 10-12, 1997, VMIC Conference 1997, ISMIC-107/97/0087(c), pp. 87-92.

Friedman, "Grain Size Refinement in a Tantalum Ingot", Metallurgical Transactions, vol. 2, No. 1, Jan. 1971, pp. 337-341.

Kock et al., Tantalum-Processing, Properties and Applications, JOM vol. 41, No. 10, Oct. 1989, pp. 33-39.

Clark et al., "Influence of Initial Ingot Breakdown on the Microstructural and Textural Development of High Purity Tantalum", Metallurgical Transactions, vol. 22A, pp. 2959-2969, Dec. 1991.

"Aluminum and Aluminum Alloys", ASM Specialty Handbook, ASM International, 1993, pp. 290-292.

Metals Handbook 8th Edition, vol. 1, "Properties and Selection of Metals", American Society for Metals, 1961, pp. 15 and 18.

F.J. Humphreys et al., "Developing Stable Fine-Grain Microstructures by Large Strain Deformation", Phil. Trans. R. Soc. Lond. A, Jun. 15, 1999, vol. 357 l#1756, pp. 1663-1681.

S. Ferrasse et al., "Texture Evolution During Equal Channel Angular Extrusion Part 1. Effect of Route, Number of Passes and Initial Texture", Materials Science and Engineering, vol. 368, Mar. 15, 2004, pp. 28-40.

V.M. Segal, "Equal Channel Angular Extrusion: From Macromechanics to Structure Formation", Materials Science and Engineering A271, Nov. 1, 1999, pp. 322-333.

Segal et al., "Plastic Working of Metals by Simple Shear", Russian Metall, vol. 1, pp. 99-105, 1991.

M. Furukawa et al., "Microhardness Measurements and the Hall-Petch Relationship in an Al-Mg Alloy with Submicrometer Grain Size", Acta Mater. vol. 44, No. 11, pp. 4619-4629, 1996.

Yoshinori Iwahashi et al., "Microstructural Characteristics of Ultrafine-Grained Aluminum Produced Using Equal-Channel Angular Pressing", Metallurgical and Materials Transactions, vol. 29A, pp. 2245-2252, Sep. 1998.

S. Ferrasse, et al., "ECAE Targets with Sub-Micron Grain Structures Improve Sputtering Performance and Cost-of-Ownership", Semiconductor Manufacturing, vol. 4, Issue 10, Oct. 2003, pp. 76-92.

Ruslan Z. Vatiev et al., "SPD-Processed Ultra-Fine Grained Ti Materials for Medical Applications". Advanced Materials & Processes, Dec. 2003, pp. 33-34.

Ruslan Z. Valiev et al., "Bulk Nanostructured Materials from Severed Plastic Deformation", Progess in Materials Science, vol. 45, 2000, pp. 103-189.

Ruslan Z. Valiev et al., "Plastic Deformation of Alloys with Submicron-Grained Structure", Materials Science and Engineering, A137, 1991, pp. 35-40.

V.M. Segal et al., "Processes of Plastic Structure Formation", Science and Engineering, 1994, published in Russia, Chapters 1,3, and 4 with Statement in Accordance with 37 CFR 1.98(a)(3)(i).

BPAI Patent Interference No. 105, 158 Judgment, Turner v. Michaluk, May 19, 2004.

Anonymous, "Solid Lubricants", Industrial Lubrication and Tribology, Nov./Dec. 1995, vol. 47, Issue 6, pp. 7-189.

"Aluminum and Aluminum Alloys", ASM International, 1993, p. 369.

Page 4. Michaluk et al. 'Methodologies for Determining the Global Texture of Tantalum Plate using X-ray Diffraction'Tantalum, The Minerals, Metal & Materials Society, 1996, p. 123-131.

* cited by examiner (a) (b)

TANTALUM PVD COMPONENT PRODUCING METHODS

RELATED APPLICATION DATA

This application is a continuation-in-part of U.S. patent application Ser. No. 09/999,095, filed Oct. 30, 2001, now U.S. Pat. No. 7,101,447, which is a divisional application of U.S. patent application Ser. No. 09/497,079, filed Feb. 2, 2000, now U.S. Pat. No. 6,331,233, the entire subject matter of which is herein incorporated by reference.

TECHNICAL FIELD

This invention relates to the processing of high-purity tantalum to produce a physical vapor deposition (PVD) component with a microstructure that is desirable for uniform deposition. In particular, the invention relates to the manufacture of high-purity tantalum with a mean grain size of less than 100 μm and a uniform, predominately (111)<uvw> crystallographic texture throughout the component thickness.

BACKGROUND OF THE INVENTION

Tantalum is currently used extensively in the electronics industry, which employs tantalum in the manufacture of highly effective electronic capacitors. Its use is mainly attributed to the strong and stable dielectric properties of the oxide film on the anodized metal. Both wrought thin foils and powders are used to manufacture bulk capacitors. In addition, thin film capacitors for microcircuit applications are formed by anodization of tantalum films, which are normally produced by sputtering. Tantalum is also sputtered in an Ar—$N_2$ ambient to form an ultra thin TaN layer which is used as a diffusion barrier between a Cu layer and a silicon substrate in new generation chips to ensure that the cross section of the interconnects can make use of the high conductivity properties of Cu. It is reported that the microstructure and stoichiometry of the TaN film are, unlike TiN, relatively insensitive to the deposition conditions. Therefore, TaN is considered a much better diffusion barrier than TiN for chip manufacture using copper as metallization material. For these thin film applications in the microelectronics industry, high-purity tantalum sputtering targets are needed.

The typical tantalum target manufacture process includes electron-beam (EB) melting ingot, forging/rolling ingot into billet, surface machining billet, cutting billet into pieces, forging and rolling the pieces into blanks, annealing blanks, final finishing, and bonding to backing plates. The texture in tantalum plate is very dependent on processing mechanisms and temperatures. According to Clark et al. in the publication entitled "Effect of Processing Variables on Texture and Texture Gradients in Tantalum" (Metallurgical Transactions A, September 1991), the texture expected to develop in cold-rolled and annealed body-centered cubic (bcc) metals and alloys consists of orientations centered about the ideal orientations, {001}<110>, {112}<110>, {111}<110>, and {111}<112>. Generally, conventionally processed tantalum is forged or rolled from ingot to final thickness, with only one (1) or no intermediate annealing stages. A final anneal is usually applied to the plate simply to recrystallize the material. The direction of the deformation influences the strengths of resulting annealed textures but generally little attention is given to the resulting distribution of textures. In conventionally processed tantalum, significant texture variation exists in the cross-section of the plate, as described by Clark et al., "Influence of Transverse Rolling on the Microstructural and Texture Development in Pure Tantalum," Metallurgical Transactions, Vol. 23A, August 1992, p. 2183-2191m; Raabe et al., "Texture and Microstructure of Rolled and Annealed Tantalum," Materials Science and Technology, Vol. 10, April 1994, p. 299-305; and Michaluk et al., "Methodologies for Determining the Global Texture of Tantalum Plate Using X-ray Diffraction," Tantalum, The Minerals, Metal & Materials Society, 1996, p. 123-131.

Typically the above mentioned textures exist in stratified bands through the thickness of the rolled plate, or form a gradient of one texture on the surface usually {100}<uvw>, with a gradual transition to a different texture at the centerline of the plate, usually {111}<uvw>. Wright et al., "Effect of Annealing Temperature on the Texture of Rolled Tantalum and Tantalum-10 wt. % Tungsten" (Proceedings of the 2nd International Conference on Tungsten and Refractory Metals, pg 501-508, 1994). Another cause of texture variation through the target thickness is the non-uniformity of the deformation processes used to form the plate. Texture non-uniformity results in variable sputter deposition rates and sputter surface irregularities, which in turn is believed to be a source of micro-arcing.

Micro-arcing is believed to believed to be the principle cause of particle generation and is thus undesirable in the semiconductor industry. FIG. 1 shows the sputter surface of a mixed-texture tantalum target made by conventional processing methods. The sputter surface reveals regions of two different crystallographic textures; dark areas are {100}<uvw>, lighter areas {111}<uvw>. The type of pattern illustrated in FIG. 1 is believed to contribute to sputter film nonuniformities because of the different sputter rates associated with each texture.

FIG. 2 shows severe textural banding in the cross-section of a sputtered tantalum target manufactured according to conventional processes. "Textural banding," refers to a localized concentration of one texture in the cross section strung out over several grains in a matrix of another texture. In tantalum, it is typically {100}<uvw> textures in a matrix of the more prominent {111}<uvw> textures. For example, a series of grains with the same {100}<uvw> texture in a matrix of {111}<uvw> that are aligned in an elongated manner over several grains is considered a banded textural feature. Using Electron Backscatter Diffraction, EBSD, imaging the texture in small, localized areas can be determined accurately.

In FIG. 2, it can be clearly seen that areas of {100}<uvw> type textures sputter at a greater rate than {111}<uvw> type textures. Thus, any textural non-uniformity at the target surface can produce surface "ridges," which have an increased likelihood of causing micro-arcing.

SUMMARY OF THE INVENTION

In one aspect of the invention, a method for producing a tantalum PVD component includes a minimum of three stages, each of which include a deformation step followed by a high-temperature anneal. The deformation occurs in air and at a component temperature less than or equal to 750° F. in at least one of the minimum of three stages. The anneal occurs at a component temperature of at least 2200° F. in at least the first two of the minimum of three stages. By way of example, the annealing may occur in an inert atmosphere. The tantalum component exhibits a uniform texture that is predominately {111}<uvw> throughout a thickness of the component.

In another aspect of the invention, a method for producing a tantalum PVD component comprising a minimum of three stages, each of which include a deformation step followed by a high-temperature anneal. The deformation occurs in air and at a component temperature of from 200° F. to 750° F. in at least the last stage or the third stage of the minimum of three stages. The anneal occurs at a component temperature of from 1500° F. to 2800° F. in at least three of the minimum of three stages. By way of example, the annealing may occur in an inert atmosphere. The tantalum component exhibits a uniform texture that is predominately {111}<uvw> throughout a thickness of the component.

BRIEF DESCRIPTION OF THE DRAWINGS

Preferred embodiments of the invention are described below with reference to the following accompanying drawings.

FIG. 9(*b*) is a photograph of an experimental sputtering target manufactured by a process according to one aspect of the invention (Process 12).

DETAILED DESCRIPTION OF THE PREFERRED EMBODIMENTS

Figure 1:
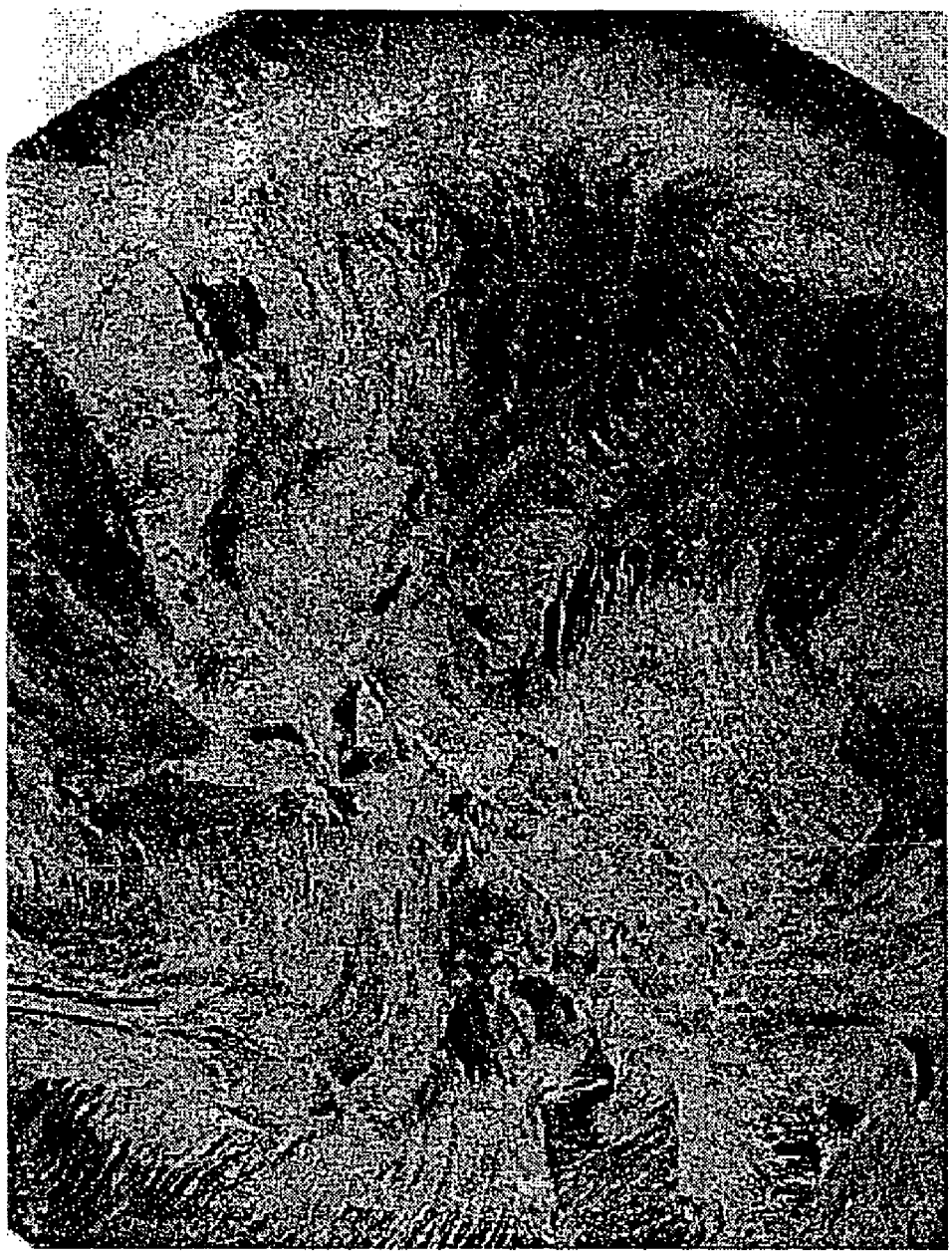
FIG. 1 is a photograph of a used high purity tantalum sputtering target with a non-uniform texture throughout the target thickness.
Figure 2:
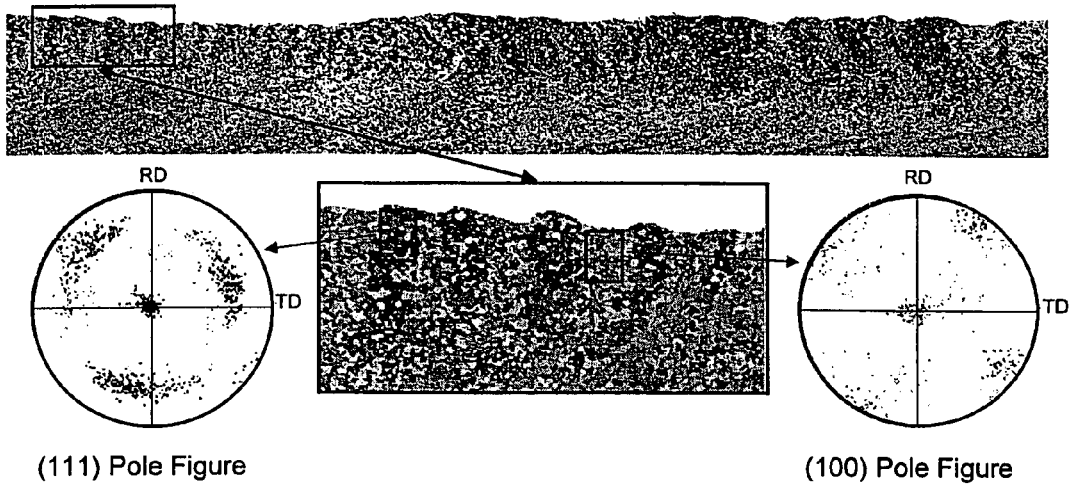
FIG. 2 is a cross-sectional EBSD image of a conventionally processed, severely banded sputtered tantalum target.

In accordance with the present invention there is provided a processing route for producing high purity tantalum PVD components with a mean fine grain size of less than 100 microns and uniform crystallographic texture throughout the component thickness. As known to those of ordinary skill, PVD includes, but is not limited to sputtering.

The method includes forging, rolling and annealing high-purity, vacuum-melted tantalum ingots in such a way as to eliminate remnant as-cast grain structure, and produce a homogeneous fine-grain size (mean<100 μm) microstructure with a uniform, predominately {111}<uvw> texture throughout the thickness of the target. Significant sputtering problems have been reported when the texture of the target is not uniform throughout the target thickness. Sputtering rates and film deposition rates can change as a function of target crystallographic texture. This variable sputter rate across a target surface causes film thickness uniformity problems and also produces unwanted surface topography in the form of "ridging," which in turn is believed to cause micro-arcing.

In one aspect, the invention uses a series of deformation techniques, with a minimum of three (3) intermediate, high-temperature inert-atmosphere anneals, preferably under vacuum conditions, to produce a fine-grain size (mean<100 μm) tantalum targets with a uniform, predominately {111}<uvw> texture throughout the target thickness that, until now, was unseen in the industry. "Uniform texture throughout the target thickness" refers to a homogeneous distribution of textural components with no visible banding at a resolution of 20× from the target surface to at least mid-thickness. "Inert" refers to an atmosphere that is non-reactive with the tantalum-containing mass.

Experiments associated with this invention also revealed that, by controlling the annealing temperature, the most desirable texture for collimated sputtering, the (111) texture, can be generated. The (111) texture is the only texture that has one of the close-packed directions aligned normal to the target surface. This direction is a dominant emission direction and is, therefore, the texture required for collimated sputtering.

The high-purity tantalum material of the present invention is preferably 3N5 (99.95%) pure and contains less than 500 ppm total metallic impurities, excluding gases. The methods of chemical analysis used to derive the chemical descriptions set forth herein are the methods known as glow discharge mass spectroscopy (GDMS) for metallic elements and LECO gas analyzer for non-metallic elements.

In the context of the present document, the term "PVD components" includes, but is not limited to, PVD targets. Deposition may occur from other components in a deposition chamber such as coils, pins, etc. and, thus, a desire may exist for PVD components other than targets to contain the materials and/or be formed by the methods described herein.

Electron beam (EB), Vacuum Arc Melted (VAR), or other vacuum melted tantalum ingots are deformed perpendicular to the ingot centerline to break up the as-cast grain microstructure. This deformation can be forging, rolling, or extrusion whereby significant cross-sectional area or thickness reduction takes place. The reduction in cross-sectional area may be greater than a reduction ratio of 3:1 (cross-sectional area of ingot to cross-sectional area of the forged billet), or equivalent to no less than about 40% strain reduction from starting thickness to final thickness. The forged billet may then be annealed in an inert atmosphere, preferably vacuum, at a high temperature greater than about 1500° F. or, advantageously, greater than 2200° F. to achieve a recrystallized microstructure. As a practical matter, anneal temperature may be from about 1500° F. to about 2800° F. or, advantageously, from 2000° F. to 2500° F. to avoid processing too hot. A particularly advantageous anneal temperature that achieves excellent results is from 2200° F. to 2400° F.

The resulting billet/plate is then deformed no less than an additional 35%, preferably 45-65%, of its thickness and subjected to a second high-temperature inert atmosphere anneal, within the same temperature ranges described for the first anneal, to achieve a recrystallized microstructure. However, the particular temperature or temperature range selected may be different from the first anneal. The process of the present invention includes an additional deformation step with a strain greater than or equal to 60% followed by a final inert-atmosphere anneal within the same temperature ranges described for the first anneal to recrystallize the microstructure to the desired fine grain size. Since grain size control is desired in the final anneal, the most advantageous temperature is from about 1750° F. to about 1800° F.

Figure 3:
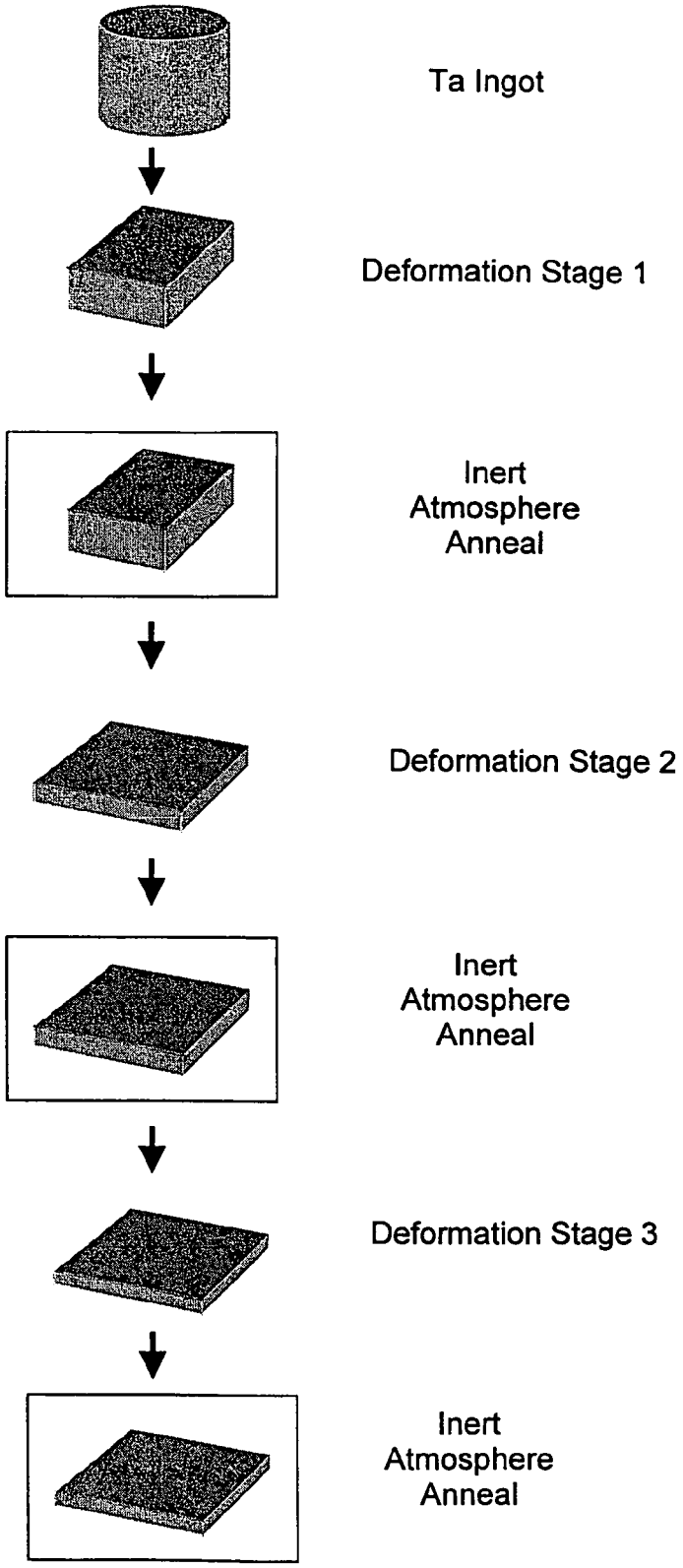
FIG. 3 is a schematic of a process according to one aspect of the invention.
Figure 4:
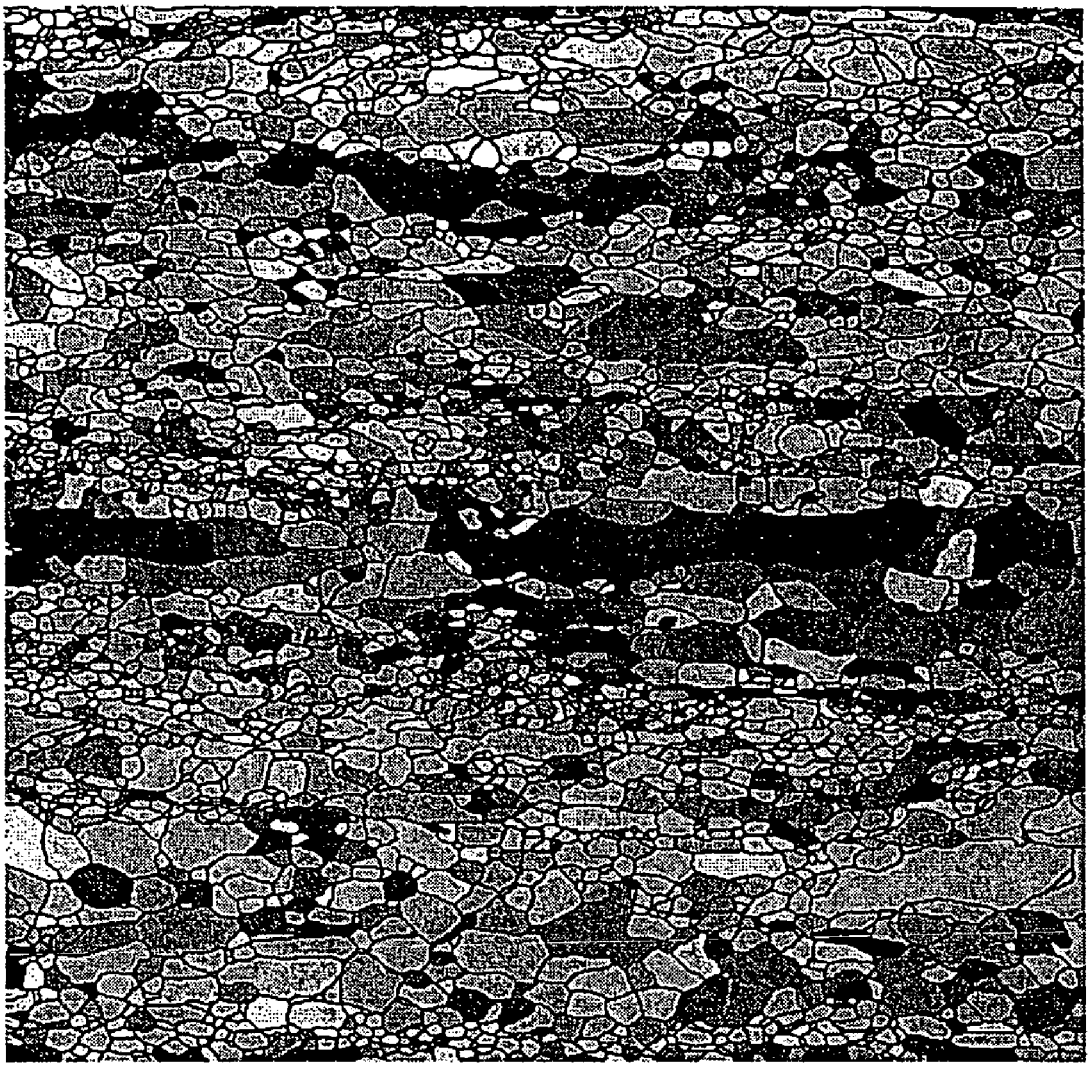
FIG. 4 is a cross-sectional EBSD image of a conventionally processed (Process 2 summarized in Table 1), severely banded high-purity tantalum sputtering target.
Figure 5:
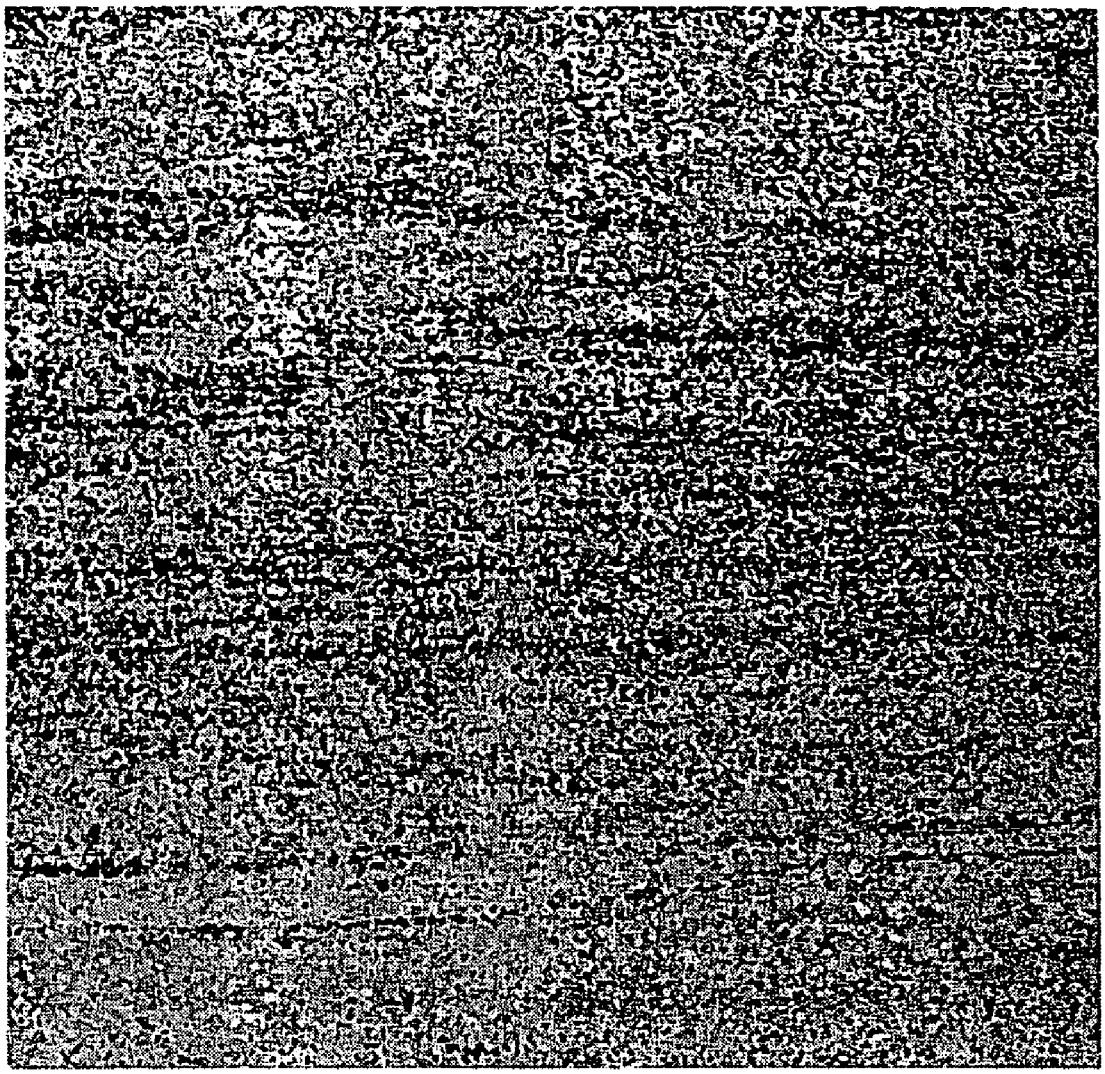
FIG. 5 is a cross-sectional EBSD image of a conventionally processed (Process 3 summarized in Table 1), high-purity tantalum sputtering target.
Figure 6:
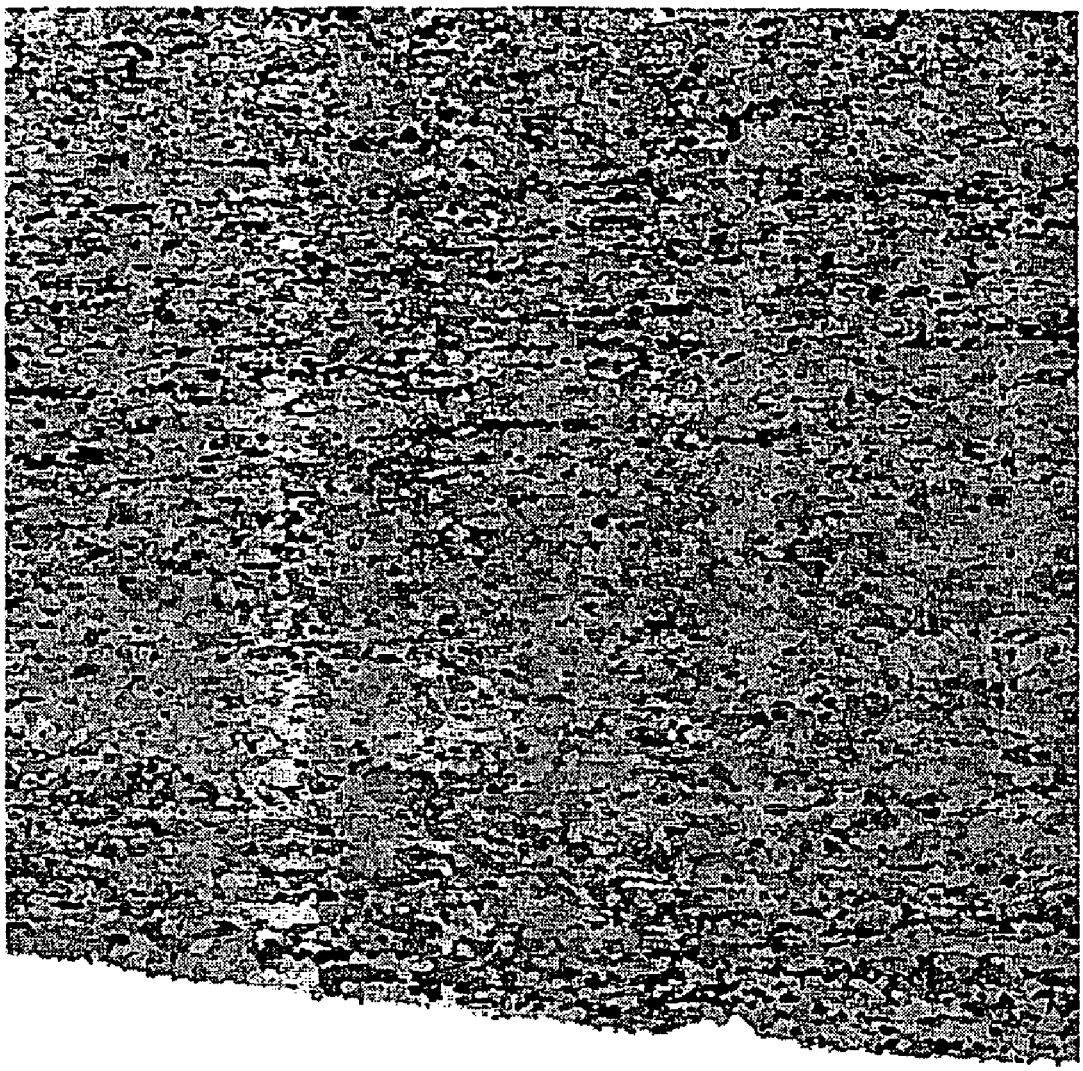
FIG. 6 is a cross-sectional EBSD image of a high-purity tantalum sputtering target manufactured by Process 4 summarized in Table 1.
Figure 7:
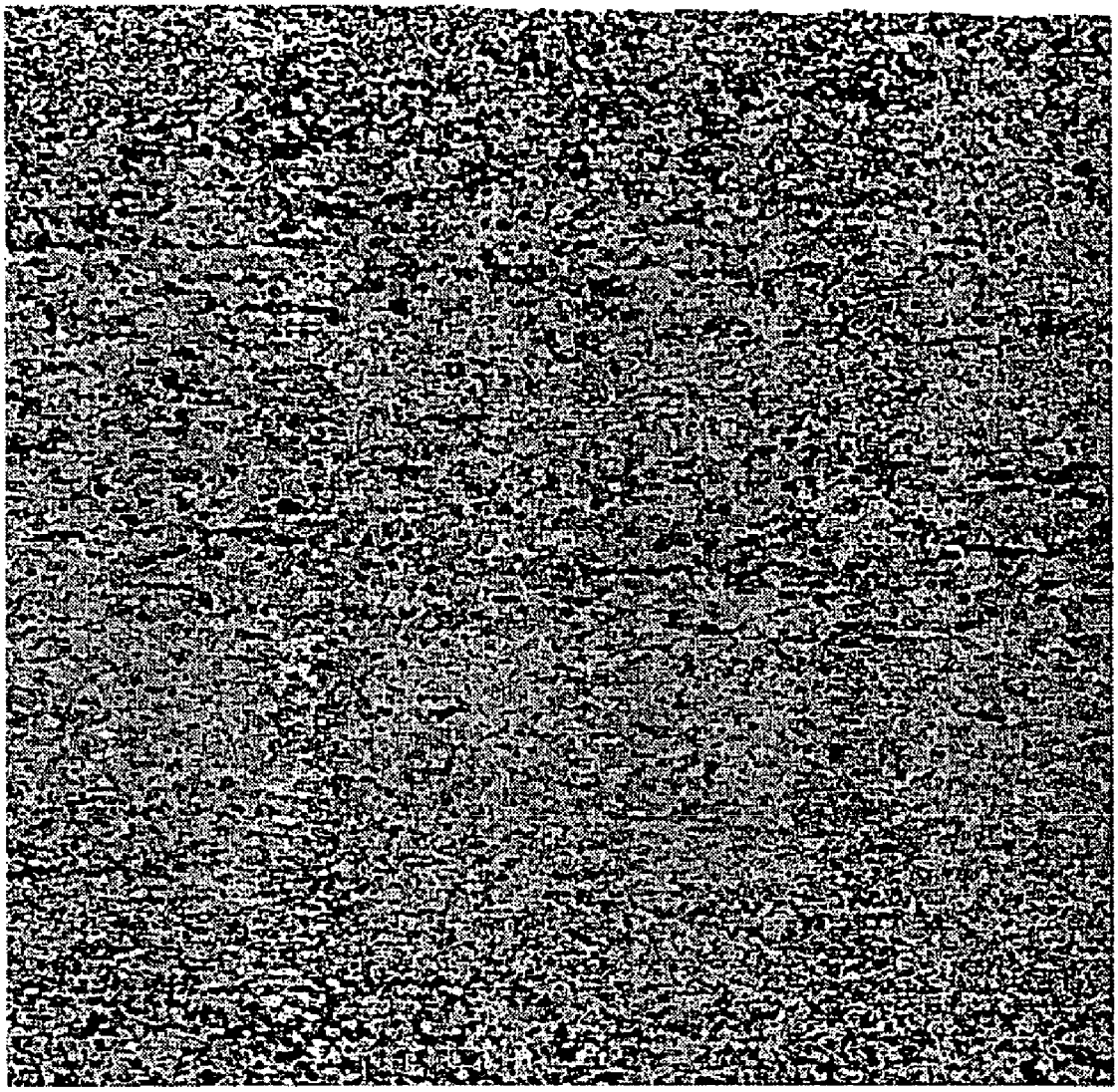
FIG. 7 is cross-sectional EBSD image of a high-purity tantalum sputtering target manufactured by Process 7 summarized in Table 1.

FIG. 3 is a schematic of the invented process. The deformation directions amenable to achieving the desired results may be used, according to the knowledge of those of ordinary skill. The process of this invention preferably utilizes no less than three deformation steps and no less than three inert-atmosphere anneal steps from ingot to final target plate thickness in order to achieve the desired results. Three or more deformation and intermediate inert-atmosphere, high-temperature annealing stages are more likely to eliminate grain size and textural banding while maintaining a mean grain size of less than 100 microns than would less than 3 deformation and annealing stages.

It may be additionally advantageous to incorporate warm deformation techniques. For example, the deformation may occur at a component temperature less than or equal to 750° F. in at least one of the stages. A temperature of from 200° F. to 750° F. may provide a greater advantage. Warm deformation in at least the last two stages, potentially three stages, of a minimum of three stages may also provide a greater advantage. Primarily, the advantage results from the yield strength of tantalum during deformation being reduced with increasing temperature. The lowered yield strength allows a greater thickness reduction, which may provide a more uniform stress distribution during deformation.

At higher temperatures, such as those used in the annealing techniques described herein, oxidation of tantalum might become a concern. Accordingly, annealing may occur in an inert atmosphere. However, deforming at 750° F. or less does not create a significant risk of tantalum oxidation and may occur in air. Deforming at 750° F. or less in air thus allows greater flexibility in thickness reduction and selection of a processing atmosphere without a significant risk of oxidation. As a practical matter, warm deformation allows the use of larger work pieces since greater thickness reductions, compared to cold deformation techniques, are possible enroute to producing a PVD component of a specified thickness. Using warm deformation, similar or improved results compared to those demonstrated in Processes 8 through 12 of Table 1 may be obtained for larger work pieces and/or may provide more uniform strain distributions.

EXAMPLE 1

Twelve high-purity tantalum ingots were processed according to conventional methods or according to aspects of the invention. The parameters for each experiment and the corresponding grain size and texture results are summarized in Table 1. Texture uniformity was measured by cutting samples from the target and analyzing them using an EBSD system on a scanning electron microscope (SEM). The mapped area was 7 mm×7 mm and was measured from the target surface to at least the plate mid-thickness. The lighter areas depict {111}<uvw> textures and the darker areas depict {100}<uvw> textures.

Figure 8:
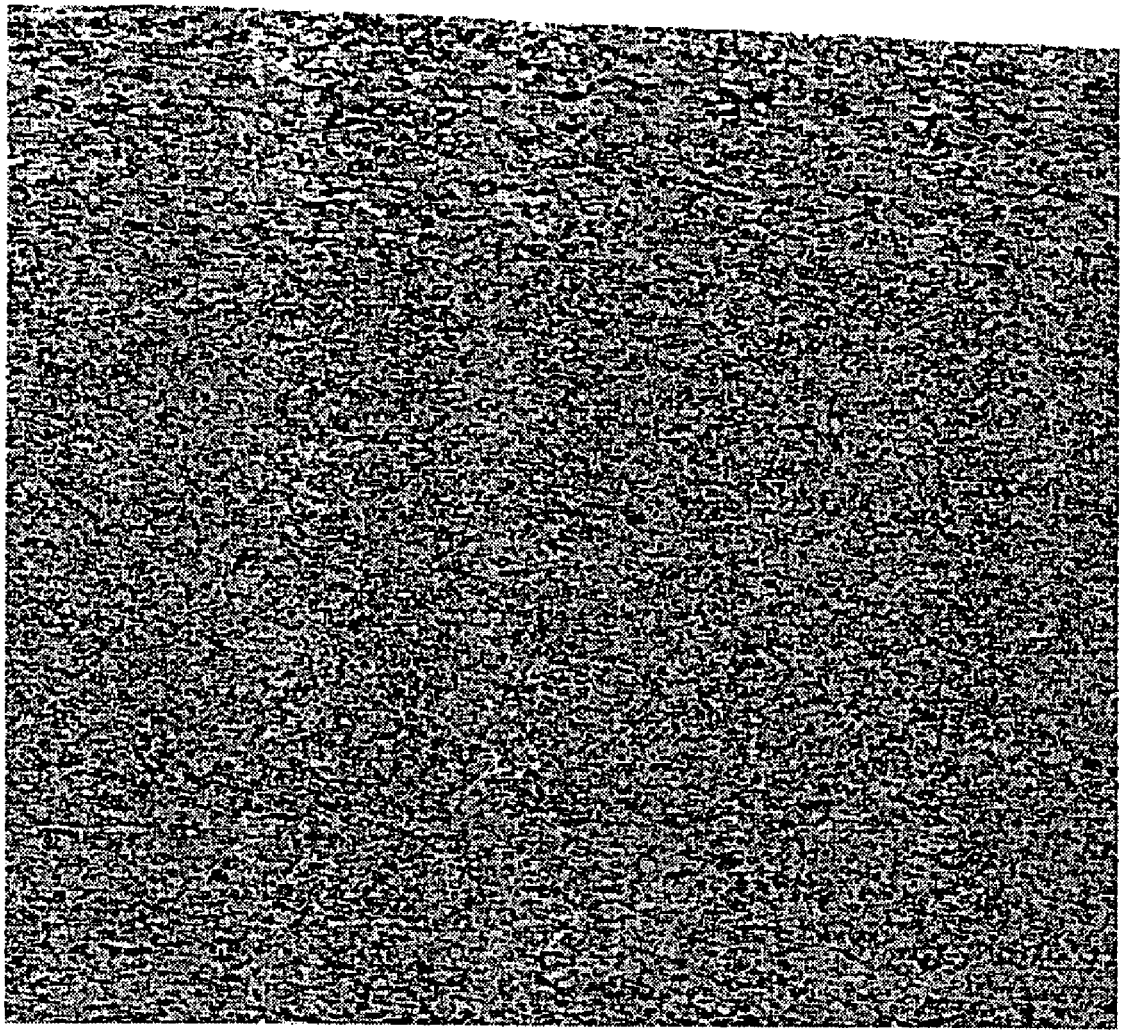
FIG. 8 is a cross-sectional EBSD image of a high-purity tantalum sputtering target manufactured by a process according to one aspect of the invention (Process 12 summarized in Table 1).

The ingots processed by conventional methods (Processes 1 through 7) exhibited a banded microstructure in both grain size and texture. FIGS. 4, 5, 6 and 7 illustrate the extent of this banding. The ingots manufactured by the invented process (Processes 8 through 12) have a strong {111}<uvw> texture with a random distribution of {100}<uvw> texture. FIG. 8, which represents a product according to aspects of the invention, shows a high degree of textural uniformity throughout the target cross-section, with no banding.

Although the experimental data show the grain size results to be less than about 50 μm it is expected that a grain size of less than 100 μm will produce similar sputtering results, so long as the texture is uniform throughout the target thickness.

EXAMPLE 2

Figure 9:
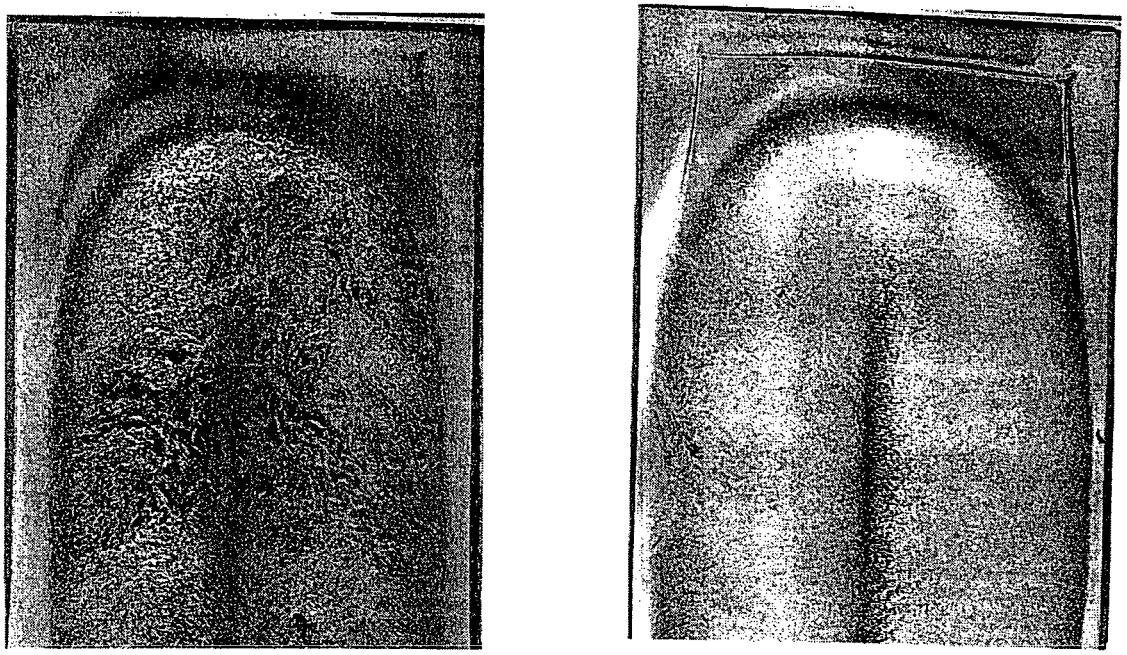
FIG. 9(*a*) is a photograph of an experimental sputtering target manufactured by a conventional method (Process 4).

Sputter trials were conducted on a conventional high-purity tantalum target and a target processed according to this invention in order to compare the sputtering characteristics. FIG. 9(*a*) and FIG. 9(*b*) are photographs of the used conventional and invented targets, respectively. The conventional target exhibits extensive surface roughness which is associated with non-uniform sputtering. This surface "ridging" in turn increases the likelihood of micro-arcing and sputter film non-uniformity. In contrast, the target processed according to aspects of the invention exhibits a smooth evenly-sputtered surface.

In compliance with the statute, the invention has been described in language more or less specific as to structural and methodical features. It is to be understood, however, that the invention is not limited to the specific features shown and described, since the means herein disclosed include preferred forms of putting the invention into effect. The invention is, therefore, claimed in any of its forms or modifications within the proper scope of the appended claims appropriately interpreted in accordance with the doctrine of equivalents.

TABLE 1

| | Process 1 Conven | Process 2 Conven | Process 3 Conven | Process 4 Conven | Process 5 Conven | Process 6 Conven | Process 7 Conven | Process 8 Invention | Process 9 Invention | Process 10 Invention | Process 11 Invention | Process 12 Invention |
|---|---|---|---|---|---|---|---|---|---|---|---|---|
| Ingot Melting Process | VAR | E-Beam | E-Beam | E-Beam | E-Beam | E-Beam | E-Beam | E-Beam | E-Beam | E-Beam | E-Beam | E-Beam |
| Purity | 4N | 4N | 3N5 | 3N5 | 4N | 3N8 | 3N8 | 3N8 | 3N8 | 4N | 3N8 | 3N8 |
| Ingot break-up (Stage I deformation) | None | None | >40% | >40% | None | >40% | >40% | >40% | >40% | >40% | >40% | >40% |
| High-temperature, inert-atmosphere anneal? | No | No | No | Yes | No | Yes | Yes | Yes | Yes | Yes | Yes | Yes |
| Stage 2 deformation | >40% | >40% | >40% | >40% | >40% | >40% | >40% | >40% | >40% | >40% | >40% | >40% |
| High-temperature, inert-atmosphere anneal? | Yes | Yes | Yes | Yes | Yes | No | No | Yes | Yes | Yes | Yes | Yes |
| Stage 3 deformation | — | — | — | — | >60% | >60% | >60% | >60% | >60% | >60% | >60% | >60% |
| High-temperature, inert-atmosphere anneal? | — | — | — | — | Yes | Yes | Yes | Yes | Yes | Yes | Yes | Yes |
| Number of anneals | 1 | 1 | 1 | 2 | 2 | 2 | 2 | 3 | 3 | 3 | 3 | 3 |
| Mean grain size (μm) | Banded 50-250 μm | Heavy Banding 100-250 μm | 35 μm | 55 μm | Banded 50-200 μm | 30 μm | 37 μm | 35 μm | 51 μm | 45 μm | 39 μm | 22 μm |

TABLE 1-continued

| | Process 1 Conven | Process 2 Conven | Process 3 Conven | Process 4 Conven | Process 5 Conven | Process 6 Conven | Process 7 Conven | Process 8 Invention | Process 9 Invention | Process 10 Invention | Process 11 Invention | Process 12 Invention |
|---|---|---|---|---|---|---|---|---|---|---|---|---|
| Texture Description | Mixed (111) & (100), banded | Mixed (111) & (100), banded | Mixed (111) & (100), banded | (111) with banded (100) | Mixed (111) & (100), banded | Mixed (111) & (100), Extreme banded | (100) at surface and (111) at center-line | Strong (111) with random distribution of (100) | Strong (111) with random distribution of (100) | Strong (111) with random distribution of (100) | Strong (111) with random distribution of (100) | Strong (111) with random distribution of (100) |
| Texture uniformity through thickness | Very Poor | Very Poor | Poor | Poor | Poor | Very Poor | Poor | Good | Excellent | Excellent | Excellent | Excellent |

I claim:

1. A method for producing a tantalum PVD component comprising a minimum of three stages, each of which include a deformation step followed by an inert atmosphere high-temperature anneal, the deformation occurring in air and at a component temperature less than or equal to 750° F. in at least one of the minimum of three stages, the anneal occurring at a component temperature of at least 2200° F. in at least the first two of the minimum of three stages, and the tantalum component exhibiting a mean grain size of less than about 100 microns and a uniform texture that is predominately {111}<uvw> throughout a thickness of the component.

2. The method of claim 1 wherein the anneal occurs at a component temperature of from 2200° F. to 2400° F. in the first two of the minimum of three stages.

3. The method of claim 1 wherein the anneal occurs at a component temperature of from about 1750° F. to about 1800° F. in the last stage of the minimum of three stages.

4. A method for producing a tantalum PVD component comprising a minimum of three stages, each of which include a deformation step followed by an inert atmosphere high-temperature anneal, the deformation occurring in air and at a component temperature of from 200° F. to 750° F. in at least the last stage of the minimum of three stages, the anneal occurring at a component temperature of from 1500° F. to 2800° F. in at least three of the minimum of three stages, and the tantalum component exhibiting a mean grain size of less than about 100 microns and a uniform texture that is predominately {111}<uvw> throughout a thickness of the component.

5. The method of claim 4 wherein the mean grain size is less then about 50 microns and the method further comprises forming a thin film tantalum-containing capacitor by:

sputtering the tantalum component to form a thin film; and forming a thin film tantalum-containing capacitor using the sputtered tantalum.

6. The method of claim 4 further comprising forming a capacitor by:

forming a first capacitor electrode;

sputtering the tantalum component to form a tantalum layer over the capacitor electrode;

anodizing the sputtered tantalum to form a capacitor dielectric; and forming a second capacitor electrode over the capacitor dielectric.

7. The method of claim 4 further comprising forming a capacitor by:

forming a first capacitor electrode;

collimated sputtering of the tantalum component to form a tantalum layer over the capacitor electrode;

forming a capacitor dielectric containing the sputtered tantalum; and forming a second capacitor electrode over the capacitor dielectric.

8. The method of claim 4 wherein the high-temperature anneal occurs at a temperature of 2000° F. to 2500° F. in at least the first two of the minimum of three stages.

9. The method of claim 4 wherein the high-temperature anneal occurs at a temperature of 2200° F. to 2400° F. in at least the first two of the minimum of three stages.

10. The method of claim 4 wherein the high-temperature anneal occurs at a temperature of about 1750° F. to about 1800° F. in the last stage of the minimum of three stages.

11. The method of claim 4 wherein the high-temperature anneal occurs at different temperatures in at least three of the minimum of three stages.

12. The method of claim 4 wherein the deformation occurs at a component temperature of from 200° F. to 750° F. in at least the last two stages of the minimum of three stages.

13. A method for producing a tantalum PVD component, comprising:

providing an initial tantalum-containing mass;

first deforming the initial mass to form a first deformed mass, the first deforming including reducing a thickness of the initial mass;

first annealing the first deformed mass at a first temperature of at least 2200° F.;

second deforming the first deformed mass to form a second deformed mass, the second deforming including reducing a thickness of the first deformed mass;

second annealing the second deformed mass at a second temperature of at least 2200° F.;

third deforming the second deformed mass to form a third deformed mass, the third deforming including reducing a thickness of the second deformed mass; and third annealing the third deformed mass at a third temperature of at least about 1500° F., one or more of the first, second, or third deforming steps occurring in air with the respective tantalum-containing mass at a temperature less than or equal to 750° F., and the tantalum component exhibiting a uniform texture that is predominately {111}<uvw> throughout a thickness of the component.

14. The method of claim 13 wherein the tantalum component exhibits a mean grain size of less than about 100 microns.

15. The method of claim 13 wherein the first and second temperatures are from 2200° F. to 2400° F.

16. The method of claim 13 wherein the third temperature is from about 1750° F. to about 1800° F.

17. A method for producing a tantalum PVD component, comprising:

providing an initial tantalum-containing mass;

first deforming the initial mass to form a first deformed mass, the first deforming including reducing a thickness of the initial mass;

first annealing the first deformed mass at a first temperature of from about 1500° F. to about 2800° F.;

second deforming the first deformed mass to form a second deformed mass, the second deforming including reducing a thickness of the first deformed mass;

second annealing the second deformed mass at a second temperature of from about 1500° F. to about 2800° F.;

third deforming the second deformed mass to form a third deformed mass, the third deforming including reducing a thickness of the second deformed mass and occurring in air with the second deformed mass at a temperature of from 200° F. to 750° F.; and third annealing the third deformed mass at a third temperature of from about 1500° F. to about 2800° F., the tantalum component exhibiting a uniform texture that is predominately {111}<uvw> throughout a thickness of the component.

18. The method of claim 17 wherein the first and second temperatures are from 2000° F. to 2500° F.

19. The method of claim 17 wherein the first and second temperatures are from 2200° F. to 2400° F.

20. The method of claim 17 wherein the third temperature is from about 1750° F. to about 1800° F.

21. The method of claim 17 wherein the first, second and third temperatures are different from one another.

22. The method of claim 17 wherein the second deforming occurs in air with the first deformed mass at a temperature of from 200° F. to 750° F.

23. The method of claim 17 wherein the first deforming comprises reducing the thickness of the mass by at least about 40%.

24. The method of claim 17 wherein the second deforming comprises reducing the thickness of the first deformed mass by at least about 35%.

25. The method of claim 17 wherein the third deforming comprises reducing a thickness of the second deformed mass by at least about 60%.

26. The method of claim 17 wherein the initial tantalum-containing mass is in the form of an ingot and wherein the third deformed mass has a thickness corresponding to a plate thickness of the tantalum component formed from the ingot.

27. The method of claim 17 wherein at least one of the first, second, and third annealing comprises vacuum annealing.

28. The method of claim 17 wherein the mass is exposed to a first ambient during the first annealing, is exposed to a second ambient during the second annealing, and is exposed to a third ambient during the third annealing; the first, second and third ambients consisting of components which are inert relative to reaction with the tantalum-containing mass.

* * * * *